US011585149B2

(12) United States Patent
Belau et al.

(10) Patent No.: US 11,585,149 B2
(45) Date of Patent: Feb. 21, 2023

(54) SYSTEMS AND METHODS FOR JOINING FENESTRATION FRAME MEMBERS

(71) Applicant: JELD-WEN, Inc., Charlotte, NC (US)

(72) Inventors: David Belau, Klamath Falls, OR (US); Jerry Jones, Klamath Falls, OR (US); Jacob Nelson, Klamath Falls, OR (US); Yoshua Gombo, Seattle, WA (US)

(73) Assignee: JELD-WEN, INC., Charlotte, NC (US)

( * ) Notice: Subject to any disclaimer, the term of this patent is extended or adjusted under 35 U.S.C. 154(b) by 106 days.

(21) Appl. No.: 16/926,187

(22) Filed: Jul. 10, 2020

(65) Prior Publication Data

US 2021/0010320 A1 Jan. 14, 2021

Related U.S. Application Data

(60) Provisional application No. 62/873,826, filed on Jul. 12, 2019.

(51) Int. Cl.

| | |
|---|---|
| ***E06B 3/96*** | (2006.01) |
| ***E06B 3/968*** | (2006.01) |
| ***E06B 3/964*** | (2006.01) |

(52) U.S. Cl.

CPC ..... *E06B 3/9612* (2013.01); *E06B 3/9645* (2013.01); *E06B 3/9681* (2013.01); *E06B 3/9682* (2013.01)

(58) Field of Classification Search

CPC ..... E06B 3/222; E06B 3/96; E06B 3/9612; E06B 3/9616; E06B 3/962; E06B 3/964; E06B 3/9645; E06B 3/9681; E06B 3/9682

See application file for complete search history.

(56) References Cited

U.S. PATENT DOCUMENTS

| | | | |
|---|---|---|---|
| 3,866,380 | A | 2/1975 | Benson |
| 4,856,230 | A | 8/1989 | Slocomb |
| 4,944,118 | A | 7/1990 | Biro |

(Continued)

FOREIGN PATENT DOCUMENTS

| | | | |
|---|---|---|---|
| CN | 204386395 U | * | 6/2015 |
| CN | 204386396 U | * | 6/2015 |

(Continued)

OTHER PUBLICATIONS

Gardner, D. J., & Murdock, D. (2010). Extrusion of wood plastic composites. University of Maine, Orono ME.

*Primary Examiner* — Ryan D Kwiecinski
(74) *Attorney, Agent, or Firm* — Lorenz & Kopf, LLP

(57) ABSTRACT

A corner joint for fenestration frames and the like includes first and second frame members having hollow interiors and ends joined in abutment. A corner key insert has legs inserted into the ends of the frame members. End portions of the legs engage the hollow interiors of the frame members forming adhesive cavities within the frame members and along the end portions of the corner key legs. Adhesive is disposed within the cavities to bond the corner key legs to the frame members, thereby creating a structural joint between the frame members. The corner key insert may include multiple injection ports for delivering adhesive to the cavities from a selected side of the frame assembly. Legs of the corner key may have notches formed therein to receive an internal wall of the frame members, and distal ends of the legs may include a flow barrier that contours along the notches.

24 Claims, 9 Drawing Sheets

(56) References Cited

U.S. PATENT DOCUMENTS

| | | | | |
|---|---|---|---|---|
| 5,837,095 | A | 11/1998 | Bruchu et al. | |
| 5,902,657 | A | 5/1999 | Hanson et al. | |
| 6,047,514 | A | 4/2000 | Verch | |
| 6,073,412 | A | 6/2000 | Verch | |
| 6,103,035 | A | 8/2000 | Hanson et al. | |
| 6,134,857 | A | 10/2000 | Hope | |
| 6,141,874 | A | 11/2000 | Olsen | |
| 6,210,507 | B1 | 4/2001 | Hansen et al. | |
| 6,265,037 | B1 | 7/2001 | Godavarti et al. | |
| 6,280,667 | B1 | 8/2001 | Koenig et al. | |
| 6,604,668 | B2 | 8/2003 | Crasser | |
| 6,680,090 | B2 | 1/2004 | Godavarti et al. | |
| 7,122,088 | B2 | 10/2006 | Field et al. | |
| 7,343,950 | B2 | 3/2008 | Field et al. | |
| 7,614,188 | B2 | 11/2009 | Hetherington et al. | |
| 7,634,880 | B2 * | 12/2009 | Sironko | E06B 3/9612 52/456 |
| 7,776,944 | B2 | 8/2010 | Griffin et al. | |
| 8,028,489 | B1 | 10/2011 | Lawrence | |
| 8,652,382 | B2 * | 2/2014 | Eggert | E06B 3/9681 264/261 |
| 8,851,787 | B2 | 10/2014 | Kelley et al. | |
| 8,857,129 | B2 * | 10/2014 | Beranek | E06B 3/9682 52/204.5 |
| 9,238,934 | B2 | 1/2016 | Booi et al. | |
| 9,649,795 | B2 | 5/2017 | Eggert et al. | |
| 9,718,235 | B2 | 8/2017 | Kelley et al. | |
| 10,890,027 | B2 * | 1/2021 | Kotiadis | E06B 3/9682 |
| 2001/0014250 | A1 | 8/2001 | Plummer et al. | |
| 2010/0000178 | A1 | 1/2010 | Eggert et al. | |
| 2013/0051902 | A1 | 2/2013 | Kelley et al. | |
| 2013/0283723 | A1 | 10/2013 | Engstrom | |
| 2014/0124979 | A1 | 5/2014 | Eggert et al. | |
| 2015/0020472 | A1 | 1/2015 | Kelley et al. | |
| 2017/0240737 | A1 | 8/2017 | Peterson et al. | |
| 2017/0240738 | A1 | 8/2017 | Ehrlichmann et al. | |
| 2017/0246780 | A1 | 8/2017 | Eggert et al. | |
| 2019/0257141 | A1 * | 8/2019 | Kotiadis | E06B 3/9645 |

FOREIGN PATENT DOCUMENTS

| | | | | |
|---|---|---|---|---|
| CN | 107524384 | A | 12/2017 | |
| CN | 206942540 | U * | 1/2018 | |
| CN | 212743774 | U * | 3/2021 | |
| DE | 20217301 | U1 * | 4/2004 | E06B 3/962 |
| DE | 202006003782 | U1 | 7/2007 | |
| DE | 102015004398 | B3 | 6/2016 | |
| EP | 0610675 | A1 | 8/1994 | |
| EP | 1580389 | A2 * | 9/2005 | E06B 3/962 |
| EP | 1580389 | A2 | 9/2005 | |
| EP | 1911925 | A2 * | 4/2008 | E06B 3/9682 |
| EP | 2154323 | A2 | 2/2010 | |
| EP | 2894024 | A1 | 7/2015 | |
| EP | 3020909 | A1 | 5/2016 | |
| FR | 2759111 | A1 | 8/1998 | |
| NO | 2019/164998 | A1 | 8/2019 | |
| WO | 87/000884 | A1 | 2/1987 | |
| WO | 02/34502 | A2 | 5/2002 | |
| WO | 2017/035608 | A1 | 3/2017 | |
| WO | WO-2017035608 | A1 * | 3/2017 | E06B 3/9682 |
| WO | WO-2020044008 | A1 * | 3/2020 | E06B 3/96 |

* cited by examiner

SYSTEMS AND METHODS FOR JOINING FENESTRATION FRAME MEMBERS

RELATED APPLICATION

This application claims the benefit of priority under 35 U.S.C. § 119(e) of U.S. Provisional Patent Application No. 62/873,826, filed Jul. 12, 2019, which is incorporated herein by reference.

TECHNICAL FIELD

The field of this disclosure relates to systems and methods for joining frame members and more particularly the corner joining of frame members of a fenestration system such as a window frame.

BACKGROUND

Fenestration systems may consist of windows, doors, and other panels installed into frames. The frames generally comprise multiple elongate frame members joined together at their ends to form a geometric shape, e.g., a square, rectangle, or some other polygon. The frame members may be straight or curved. In some cases, frame members are formed of a polymer or composite material using an extrusion process that facilitates the formation of complex cross-sectional shapes and relatively thin perimeter walls surrounding hollow portions. In some cases, end-to-end joining of extruded frame members incorporates a structural component inserted into hollow internal spaces in the extruded frame members. When, frame members are joined together at a corner, the structural insert is often referred to as a corner key. The corner key may be attached to the frame members via mechanical fasteners such as screws, rivets, etc. or via adhesive. When adhesive is used, the joint is optionally formed by assembling the joint prior to applying the adhesive and then injecting liquid adhesive through an injection port on an exterior surface or corner ridge of the frame members at or near the joint. International Publication No. WO 02/34502 A2 describes one such internally bonded joint structure utilizing an injectable corner insert and an injection port formed in the lineal frame members along the joint line.

The present inventor has recognized a need for improved joints and joining methods that may reduce cost and/or enhance the appearance of finished products.

SUMMARY

A structural joint for internally adhesively joining first and second frame members that are hollow and extruded, or which have hollow receiving regions, utilizes an injectable insert also known as a corner key. The corner key insert includes a first leg disposed within the first hollow receiving region to form a first adhesive-receiving cavity between the first leg and the first perimeter wall, and a second leg disposed within the second hollow receiving region to form a second adhesive-receiving cavity between the second leg and the second perimeter wall. The insert may further include a distribution pathway in fluid communication with the first cavity and the second cavity, a first injection port in fluid communication with the distribution pathway, and a second injection port in fluid communication with the distribution pathway, wherein the second injection port is spaced apart from the first injection port. To complete the joint, an adhesive material injected through the first injection port at least partially fills the distribution pathway, the first cavity, and the second cavity, wherein the adhesive material in the first and second cavities bonds the insert to the first and second frame members, respectively.

In another aspect of the disclosure, an insert for joining frame members of a fenestration system or other structures includes first and second legs insertable into hollow end portions of a pair of frame members, and a distribution pathway arranged on the insert. The distribution pathway receives adhesive injected through either of first or second injection port of the insert, or both, and directs the flow of the adhesive material into cavities formed between each of the first and second legs and the respective frame members into which they are inserted.

The present disclosure also teaches a novel method of making a fenestration frame from multiple elongate frame members or joining any two parts having hollow receiving regions bordered by perimeter walls. The method involves obtaining an insert including recesses in first and second legs thereof and a pair of injection ports in fluid communication with the first and second recesses, then forming an aperture in a perimeter wall of a selected frame member to align with one of the injection ports, while the other injection port is covered by another frame member or other part to be joined. This enables adhesive material to be injected via a nozzle aligned with the aperture and injection port on a desired side of the joint, and into cavities formed between the insert and the perimeter walls of the frame members. The adhesive material is then cured in the cavities to bond the insert to the frame members and form a secure adhesively bonded joint. Having dual injection ports provides flexibility in manufacturing and design of the frame unit and may improve the appearance of the finished product.

In some embodiments, the legs of the insert include notches that receive internal ribs within the frame members. In some embodiments, the legs include a stepped margin, shoulder, or protrusion that provides a flow barrier and/or a seal along distal edges or margin of the legs to contain and limit the flow of adhesive injected into the insert.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
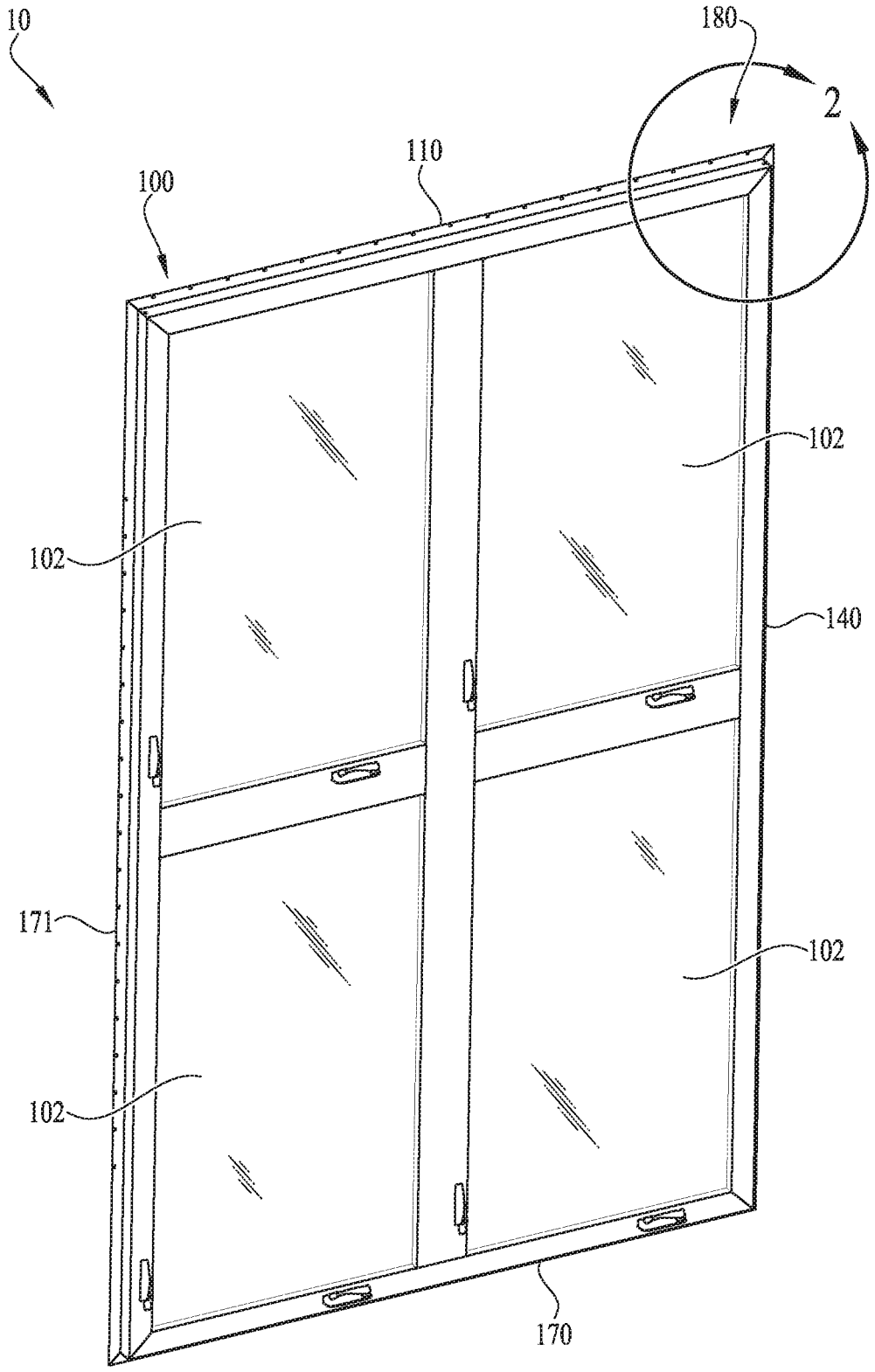
FIG. 1 is an isometric front view of a window, including a frame supporting four window sashes.

FIG. 1 is a front isometric view of a fenestration system in the form of a window unit 10 including a fenestration frame 100 (or window frame) in accordance with one exemplary embodiment of the present disclosure. In the embodiment illustrated, fenestration frame 100 (hereafter referred to as "frame 100") is a window frame supporting four movable window sashes 102, but the inventions, techniques and structures described with reference to frame 100 may also be applied to window sash frames, door frames, sidelite frames, any other fenestration system or component thereof involving joined members, especially hollow frame members joined at a corner, and any other joinery, including joinery for items other than fenestration systems, such as cabinetry, walls, ceilings, stairs, furniture, and other structures. Throughout this disclosure, the interior-facing side of frame 100 shown in FIG. 1 shall be referred to as the front side of frame 100, and the exterior-facing side opposite the front side will be referred to as the rear side of frame 100. The front and rear designations are intended to be non-limiting and may be perpetuated in reference to components of frame 100, as described below. Frame 100 includes opposing rails identified as a first frame member 110 (or head rail) and a third frame member 170 (or sill), and opposing side jambs identified as a second frame member 140 and a fourth frame member 171.

First and second frame members 110 and 140 are joined together end-to-end at a corner joint 180 in accordance with one aspect of the present disclosure. The lineal frame members 110, 140, 170, 171 may be identical in cross section, and the joints at the other three corners of frame 100 may be identical to corner joint 180, which is described in detail below. Frame 100 can be of any suitable geometry such as rectangular (including square) as illustrated, or any other geometry having at least one joint. Corner joint 180 is illustrated as a right-angle corner joint, although non-right-angle corner joints and joints not forming a corner could also be implemented consistent with the techniques and principles used in corner joint 180, as described below.

Figure 2:
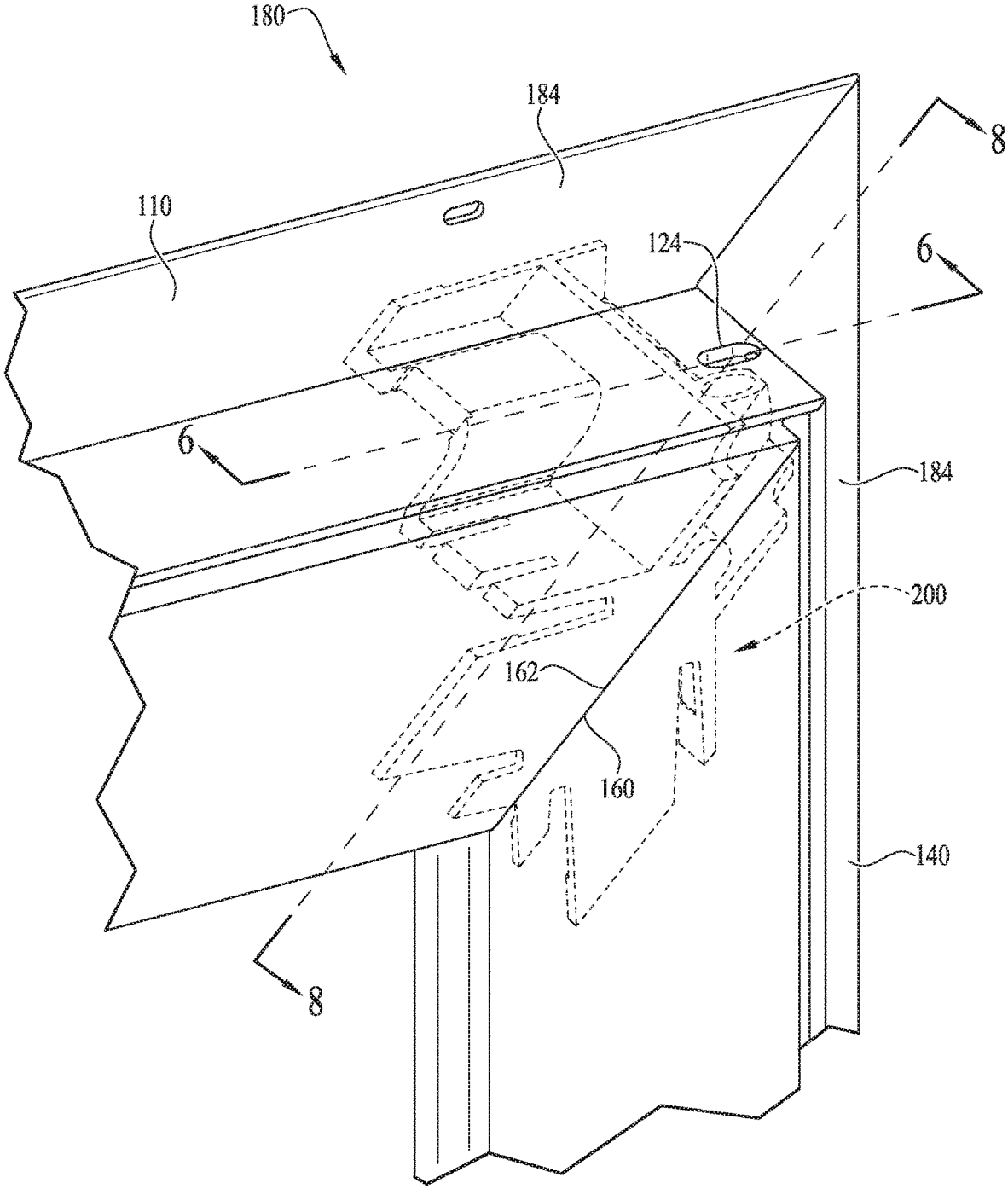
FIG. 2 is an isometric front detail view of a corner joint of the frame of FIG. 1, including a "corner key" joinery insert illustrated in hidden lines.

FIG. 2 is an isometric front detail view of corner joint 180. Corner joint 180 is illustrated as joining mitered ends 160, 162 of respective first and second frame members 110 and 140. In other embodiments (not shown), joined ends 160, 162 of the respective first and second frame members 110 and 140 may not be mitered. FIG. 2 illustrates a structural joinery insert called a "corner key" 200 in hidden lines. Corner key 200 is disposed within the interiors of first and second end portions 166, 168 of the respective first and second frame members 110 and 140. For clarity in description, first frame member 110 and second frame member 140 are described as being joined together at their proximal ends. As such, first and second frame members 110, 140 extend distally away from an apex, ridgeline 276 (FIG. 4), corner, or joint line of the joint.

Figure 3:
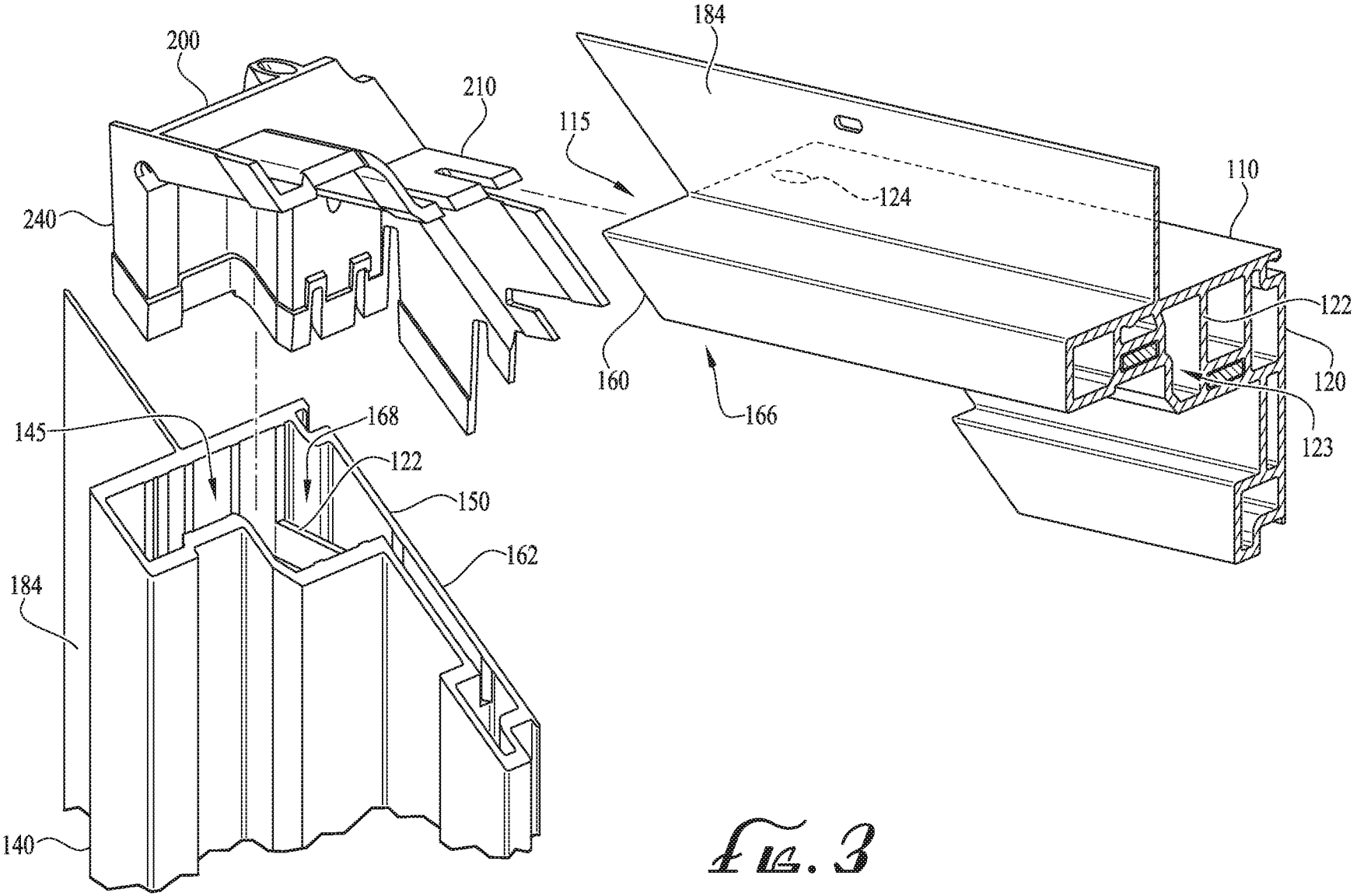
FIG. 3 is an exploded isometric rear view of the corner joint of FIG. 2.

FIG. 3 illustrates corner joint 180 in an exploded isometric rear view. With reference to FIG. 3, first frame member 110 may include a first perimeter wall 120 extending around a perimeter of a cross-sectional area of first frame member 110 and bordering one or more hollow regions 123 (also referred to as hollow portions, receiving regions, sockets, hollow end regions, or hollow end portions), which are preferably accessible at the ends 160, 162 of frame members 110, 140. First frame member 110 may include one or more longitudinally-extending internal webs or ribs 122, some of which may span between and couple together opposing portions of first perimeter wall 120 and divide the internal space into two or more hollow regions 123. Internal ribs 122 may provide structural support and/or serve other purposes, such as a thermal break. In similar fashion, second frame member 140 may also include a second perimeter wall 150 and one or more internal ribs 122. Third and fourth frame members 170, 171 may have similar hollow regions, ribs, and perimeter walls. Each of the frame members 110, 140, 170, 171 may optionally include a nailing fin 184 extending peripherally from its outer perimeter wall. In a preferred embodiment, frame members 110, 140, 170, 171 may be formed of an extruded polymer or composite material, such as polyvinyl chloride (PVC) or a PVC-wood fiber composite (aka wood-vinyl composite or WVC). In other embodiments, frame members 110, 140, 170, 171 may be formed of another material, such as metal or wood, and may be made via extrusion (if metal or plastic) or by another method. In some embodiments (not shown), the hollow receiving regions or sockets may be formed and accessible along the sides of some of the frame members instead of the ends. The hollow receiving regions 123 will typically extend through the length of frame members 110, 140, 170, 171, but in some embodiments the hollow receiving regions may be present only at the ends of frame members 110, 140, 170, 171.

In the illustrated embodiment, an end portion of one or more of the internal ribs 122 is removed from the first and/or second frame members 110 and/or 140 after extrusion, for example via an end-milling operation performed either before or after mitering. Removing and end portion of internal ribs 122 merges two or more of the extruded receiving regions 123 to provide enlarged receiving regions 115, 145 at proximal ends 160, 162 of the first and second frame members 110, 140, respectively. Receiving regions 123, 115 of first frame member 110 receive a first leg 210 of corner key 200, and receiving regions 123, 145 of second frame member 140 receive a second leg 240 of corner key 200. The first and second legs 210 and 240 are joined together at their proximal ends, and extend distally into receiving region 115 and receiving region 145, respectively. First leg 210 and second leg 240 form an angle therebetween corresponding to the angle of corner joint 180, e.g., a right angle in the illustrated embodiment. In other embodiments, first and second legs 210, 240 may form any other angle therebetween, for example any angle between 10 and 180 degrees, or may be curved.

Figure 4:
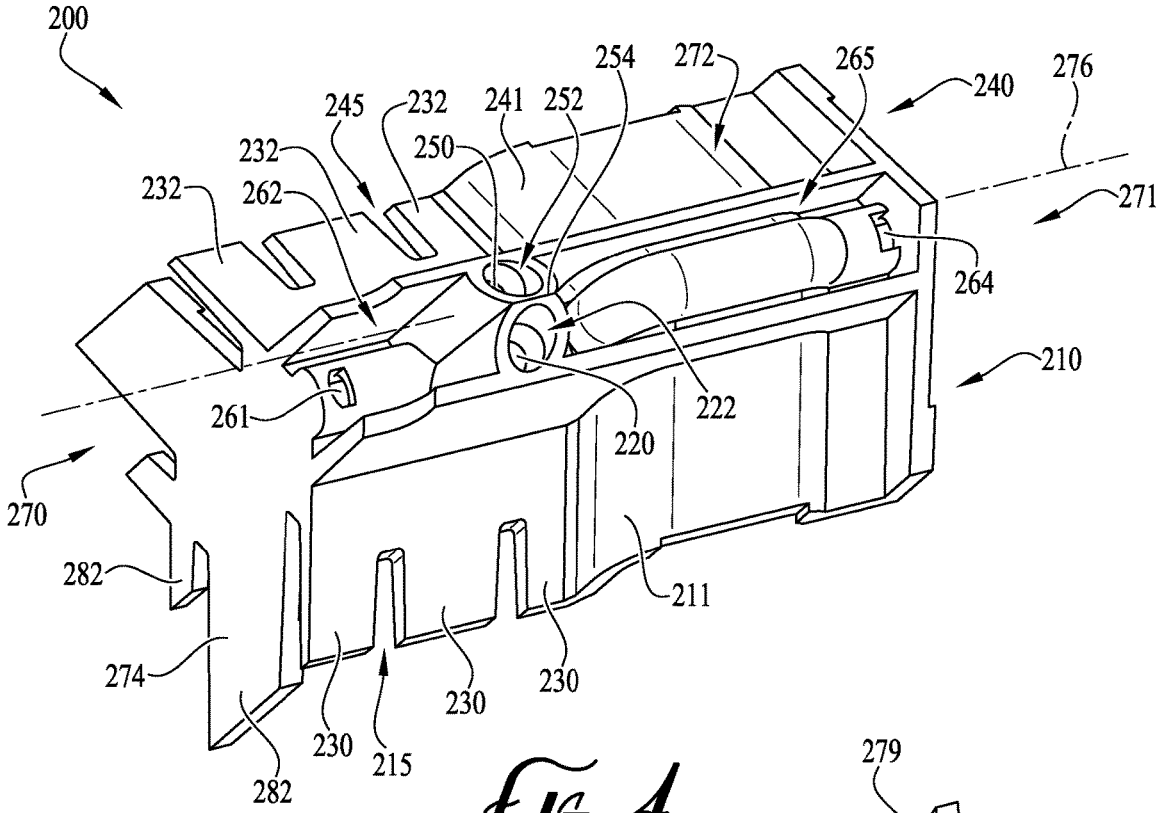
FIG. 4 is an outer isometric view of the corner key of FIG. 3.
Figure 5:
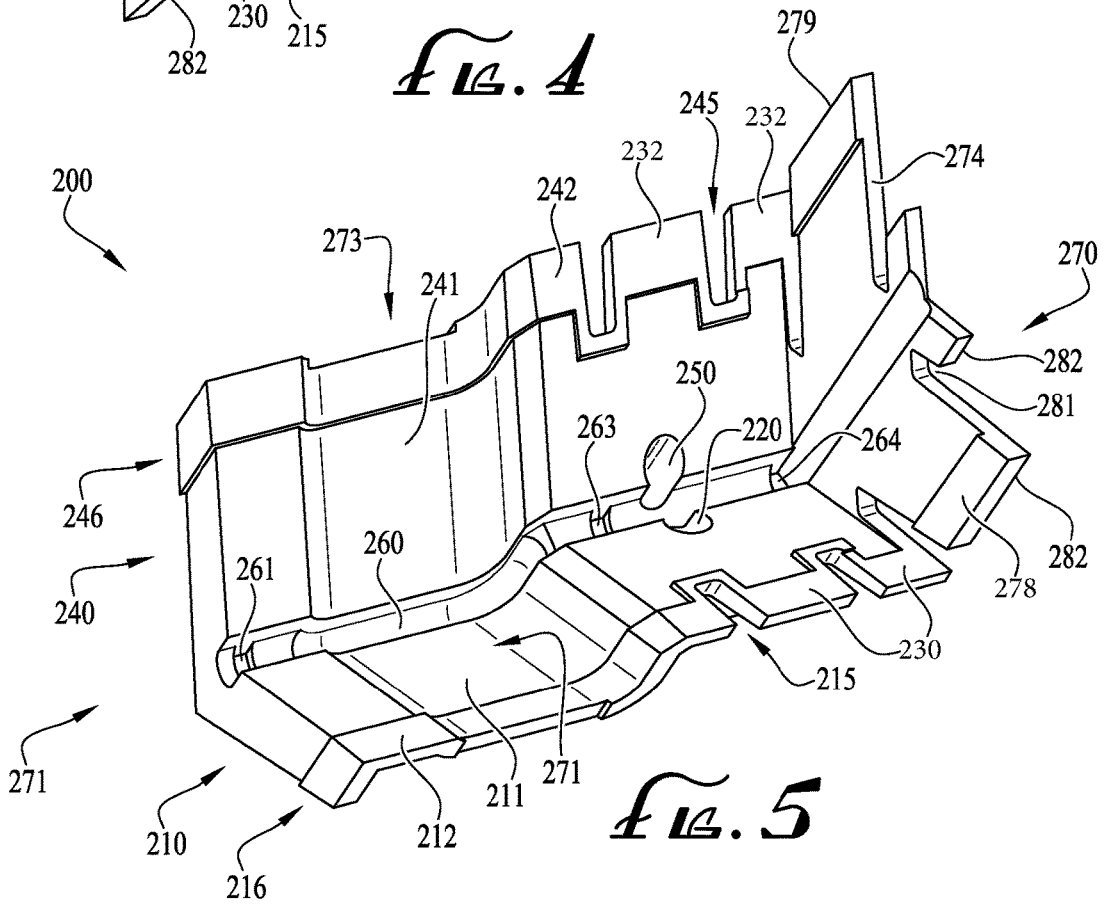
FIG. 5 is an inner isometric view of the corner key of FIG. 3.

FIGS. 4 and 5 illustrate respective top and bottom sides 272 and 273 of corner key 200. For illustration purposes, corner key 200 has a front side 270 and a rear side 271 corresponding to the front and rear sides of frame 100. In the illustrated embodiment, first leg 210 and second leg 240 may include the same or similar features and may be mirrored across an axis or plane of symmetry intersecting a real or virtual ridgeline 276 of corner key 200. In the embodiment illustrated, the plane of symmetry corresponds to the plane of the joint where the mitered ends 160, 162 of respective frame members 110, 140 meet. As such, description herein of features of first leg 210 may apply to second leg 240 and vice versa. For simplicity, certain descriptions of features of one leg may not be repeated for the other leg. Corner key 200 may be injection molded from a polymer resin or composite material in a unitary one-piece construction.

First leg 210 includes a first wall 211 which may be shaped to follow at least a portion of an interior contour of the first perimeter wall 120 of frame member 110. First wall 211 may extend substantially along and follow the contour of first perimeter wall 120 from front side 270 to rear side 271 of corner key 200. First wall 211 may include a stepped margin, shoulder, or protrusion 212 (also referred to as a sealing dam) disposed along a distal edge 216 of first wall 211 of first leg 210 and projecting outwardly from the surface of first wall 211, thereby forming a recess 113 along a side of first leg 210 and proximal of protrusion 212. Similar to first wall 211, protrusion 212 may also follow the interior contour of first perimeter wall 120. Protrusion 212 may define an adjacent recessed portion 213 of first leg 210 that establishes a gap between the first wall 211 and the first perimeter wall 120 when the first leg 210 is slidably inserted into receiving region(s) 123 and/or 115 of the first frame member 110 to thereby create a first adhesive-receiving cavity 214 bordered by first wall 211 of corner key 200, first perimeter wall 120 of frame member 110, and protrusion 212. Protrusion 212 may provide a flow barrier and/or a seal along distal edge 216 or margin of first cavity 214 and first wall 211 to contain and limit the flow of adhesive injected into corner key 200, as further described below with reference to FIGS. 7 and 8.

Second leg 240 includes a second wall 241 having a protrusion 242 similar to protrusion 212 of first leg 210. Protrusion 242 may define an adjacent second recessed portion 243 of second leg 240 that establishes a gap between second wall 241 and second perimeter wall 150 of second frame member 140 when second leg 240 is slidably inserted into receiving region(s) 123 and/or 145 of second frame member 140 to thereby create a second adhesive-receiving cavity 244 bordered by second wall 241, second perimeter wall 150, and protrusion 242. Protrusion 242 may provide a flow barrier for adhesive along distal edge 246 or margin of second cavity 244 and second wall 241 to contain and limit the flow of adhesive injected into corner key 200, as further described below with reference to FIGS. 7 and 8.

First leg 210 may include one or more slots or notches 215 in distal edge 216 to receive and nest with one or more internal ribs 122 of first frame member 110. Notches 215 divide first leg 210 into multiple tines 230, each of which is slidably insertable into hollow receiving regions 123 of first frame member 110. Similarly, second leg 240 may include one or more slots or notches 245 in distal edge 246 of second wall 241 to receive and nest with one or more internal ribs 122 of second frame member 140; and notches 245 divide second leg 210 into multiple tines 232, each of which is slidably insertable into hollow receiving regions 123 of second frame member 140. To accommodate the portions of the first and second walls 211, 241 that remain beyond the bases of the notches 215, 245, an end portion of the internal ribs 122 may be removed, for example by end-milling, before assembly of corner key 200 with first and second frame members 110, 140. Notches 215, 245 may improve the structural connection and interface with first and second frame members 110, 140, while also reducing the depth of an end-milling operation necessary to remove a sufficient portion of ribs 122 to form enlarged receiving regions 115, 145 and allow for fully seating corner key 200 therein. Protrusions 212, 242 may follow the contour of notches 215, 245, respectively, so as to extend along the sides and base of notches 215, 245, and thus maintain a flow barrier around notches 215, 245. In some embodiments, channels (not shown) may be provided in protrusions 212, 242 in the region of notches 215, 245 to direct a small amount of adhesive to the interface between notches 215, 245 and ribs 122, for enhanced bonding between corner key 200 and frame members 110, 140.

Corner key 200 may also include a front blade portion 274 having first and second protrusions 278, 279, notches 281, and tines 282, that are slidably inserted in receiving regions 123 of first and second frame members 110, 140 to form additional adhesive-receiving cavities between front blade portion 274 and perimeter walls 120, 150. A portion of the distal edges or margins of front blade portion 274 may be without protrusions due to the location of the blade portion 274 at the far end of the flow pathway for adhesive and to provide a restrictive outlet for excess adhesive.

Corner key 200 includes a first injection port 220 having a nozzle-receiving end 222 located along a proximal portion or base of first leg 210, and a second injection port 250 spaced apart from first injection port 220 and having a nozzle-receiving end 252 located along a proximal portion or base of second leg 240. First and second injection ports 220, 250 may be circular and tubular, and may share a common wall region 254. First and second injection ports 220, 250 may be mirrored across the plane of symmetry and may extend in a direction parallel to the plane of symmetry to simplify mold design so that corner key 200 may be injection molded without the use of slides or special side-action parts in the mold. For a right-angle corner, injection ports 220 and 250 are preferably oriented at a 45-degree angle relative to first and second legs 210, 240 and substantially parallel to the major surface of front blade portion 274 of corner key 200. Nozzle-receiving ends 222, 252 are preferably aligned with legs 210, 240, however. Thus, the outer face of nozzle-receiving ends 222 and 252 may lay at 45-degree angles relative to the tubular portions of injection ports 220, 250, resulting in nozzle-receiving ends 222, 252 being oval shaped. Nozzle-receiving ends 222, 252 of injection ports 220, 250 may include a chamfered seat or funnel-shaped portion 256 for receiving and seating against an injection nozzle, as described below with reference to FIG. 6.

First and second injection ports 220, 250 extend through the corner key 200. First injection port 220 extends through first leg 210 and at least partially through first wall 211 of first leg 210, with nozzle-receiving end 222 of first injection port 220 facing away from an outside surface of first wall 211 and an outlet end of first injection port 220 located along an inside surface of first wall 211 opposite the outside surface of first wall 211. Second injection port 250 extends through second leg 240 and at least partially through second wall 241 of second leg 240, with nozzle-receiving end 252 of second injection port 250 facing away from an outside surface of second wall 241 and an outlet end of second injection port 250 located along an inside surface of second wall 241 opposite the outside surface of second wall 241.

First injection port 220 is positioned such that when first leg 210 is inserted into receiving region 115 of first frame member 110, nozzle receiving end 222 is positioned adjacent or abutting an inside surface of perimeter wall 120. Corner key 200 may include a fluid distribution pathway 260 in fluid communication with first and second injection ports 220, 250 and first and second recesses 213, 243, and thereby providing a fluid flow path from each of the first and second injection ports 220, 250 to both of the first and second cavities 214, 244. The distribution pathway 260 may comprise a channel located along an inside corner (bottom side 273) of corner key 200 and may extend substantially between front side 270 and rear side 271 of corner key 200, and perpendicular to the tubular portion of first and second injection ports 220, 250. Distribution pathway 260 is arranged to direct adhesive injected through either or both of injection ports 220 and 250 to flow into both first and second cavities 214, 244, when corner key 200 is mated with frame members 110, 140, with first and second legs 210 inserted into respective first and second receiving regions 115, 145 of frame members 110, 140. In some embodiments, first cavity 214 may be in fluid communication with the distribution pathway 260 along a substantial portion of the length of distribution pathway 260, i.e., more than about 50 percent of the length, more than about 75 percent of the length, or approximately along the complete length of distribution pathway 260.

Second injection port 250 is positioned such that when second leg 240 is inserted into receiving region 145, nozzle receiving end 252 of second injection port 250 is positioned adjacent or abutting an inside surface of perimeter wall 150 of second leg 240, so that perimeter wall 150 covers nozzle-receiving end 252. Similar to first cavity 214, the distribution pathway 260 may be in fluid communication with the second cavity 244 along at least a portion of the length of the distribution pathway 260. In some embodiments, the second cavity 214 may also be in fluid communication with the distribution pathway 260 along a substantial portion of the length of the distribution pathway 260, i.e., more than about 50 percent of the length, more than about 75 percent of the length, or approximately along the complete length.

Corner key 200 may include a third adhesive-receiving cavity 262 disposed on top side 272 and toward front side 270 of corner key 200. Third cavity 262 may be fluidly coupled to distribution pathway 260 via a first transfer port 261. Corner key 200 may also include a fourth adhesive-receiving cavity 265 disposed on top side 270 and toward rear side 271 of corner key 200. Fourth cavity 265 may be fluidly coupled to distribution pathway 260 via a second transfer port 263 and/or a third transfer port 264.

Figure 6:
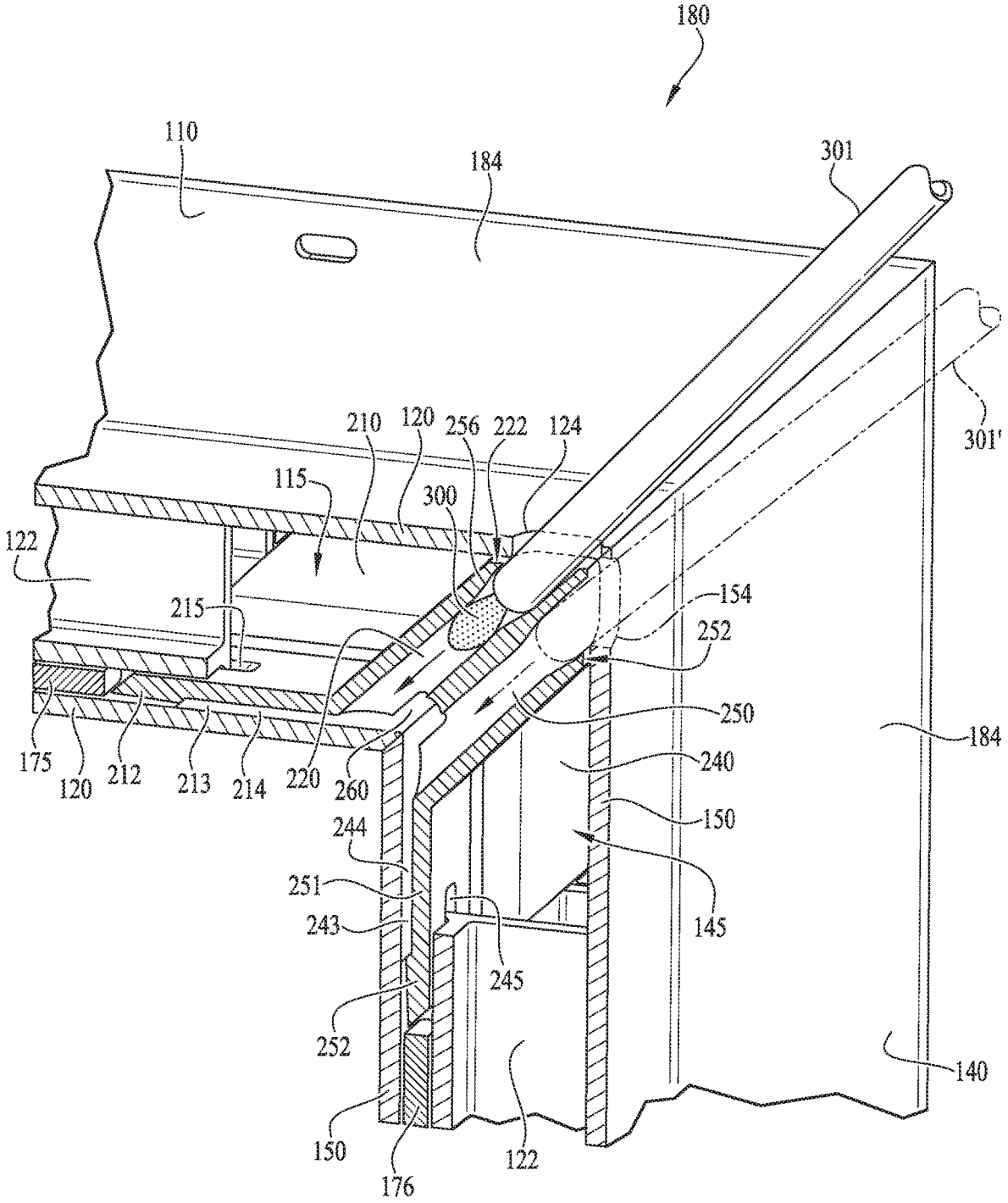
FIG. 6 is a cross-sectional view of the corner joint of FIG. 2, taken along line 6-6 in FIG. 2, with an injection nozzle shown injecting adhesive into the corner key.

FIG. 6 is a front cross-sectional view of corner joint 180 cut along sectioning line 6-6 as indicated in FIG. 2. First leg 210 is disposed within receiving region 115 of first frame member 110 and second leg 240 is disposed within receiving region 145 of second frame member 140. First wall 211 of first leg 210 is positioned opposite first perimeter wall 120 forming gap and first cavity 214 therebetween. Similarly, second wall 241 of second leg 240 is positioned opposite second perimeter wall 150 forming a gap therebetween, and second cavity 244 being at least partially defined by the gap between second wall 241 and second perimeter wall 150.

A first aperture 124 is formed through first perimeter wall 120 in alignment with the nozzle receiving end 222 to provide access for the injection nozzle 301 to the nozzle receiving end 222. More particularly, aperture 124 is formed through first perimeter wall 120 into receiving region 115 at a location such that first injection port 220 will align with aperture 124 when first leg 210 is fully inserted into and seated in receiving region 115 of first frame member 110. Alternatively, or additionally, a second aperture 154 may optionally be formed in second perimeter wall 150, if it is desired to inject adhesive into corner key 200 through second injection port 250 from a different side of frame 100. A flowable adhesive material 300, is injected through nozzle 301 and into the selected injection port 220, 250. Adhesive material 300 may be any adhesive that can be applied in a liquid and cure or harden to a solid or semi-solid form within 30 seconds to 5 minutes for initial green strength, and may achieve a full cure within 7 days. Suitable adhesive materials 300 may include thermoplastic materials, thermoset materials, or other resins. The curing method can be by cooling, heat reactive, chemical reactive, moisture reactive, ultraviolet, other light, and/or radio-frequency radiation, or by time only.

Figure 8:
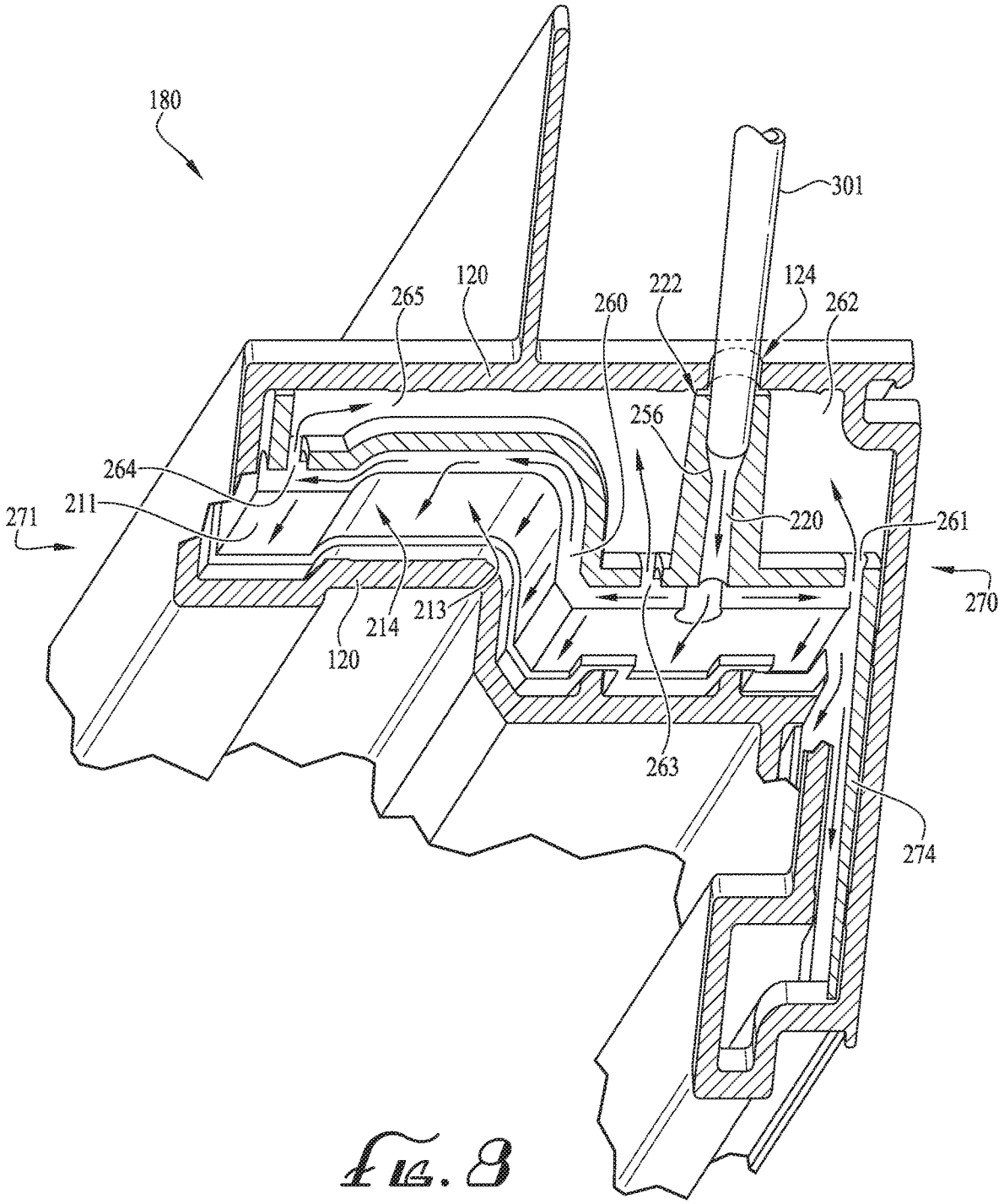
FIG. 8 is a cross-sectional view of the corner joint of FIG. 2, taken along line 8-8 in FIG. 2, with the injection nozzle of FIG. 6, and illustrating distribution pathways for adhesive material injected via the injection nozzle.
Figure 9:
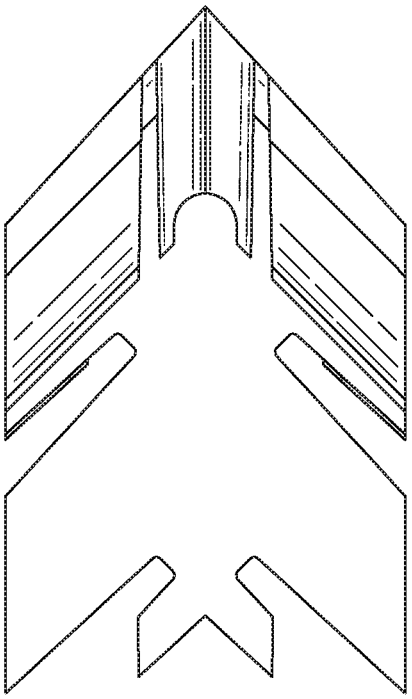
FIG. 9 is a front view of the corner key of FIG. 4.
Figure 10:
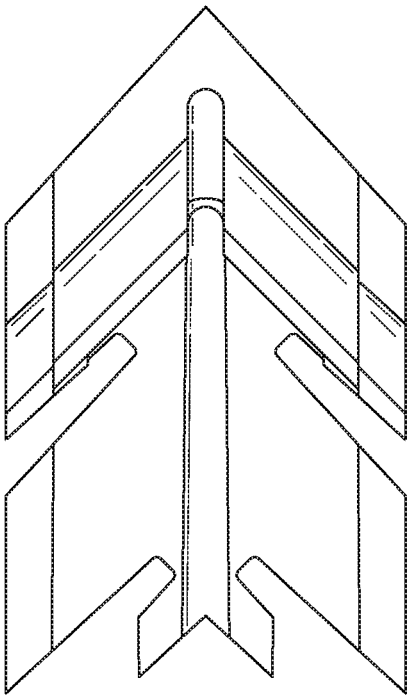
FIG. 10 is a rear view of the corner key of FIG. 4.
Figure 11:
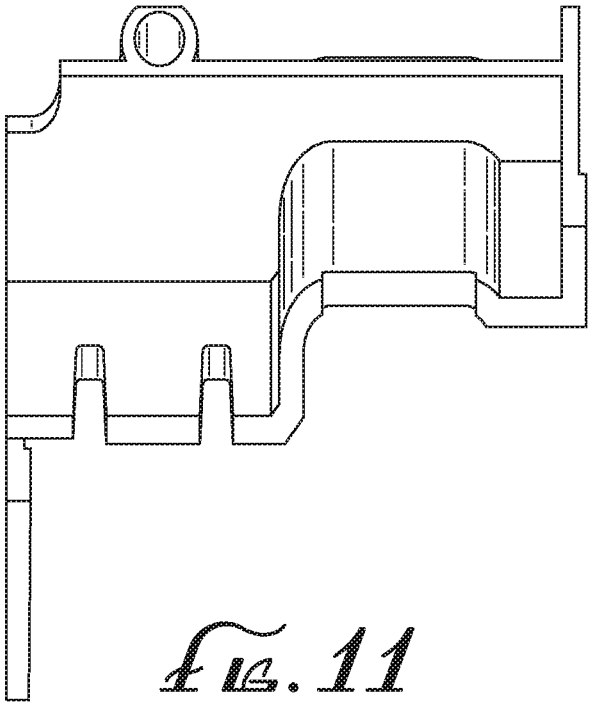
FIG. 11 is a right side view of the corner key of FIG. 4.
Figure 12:
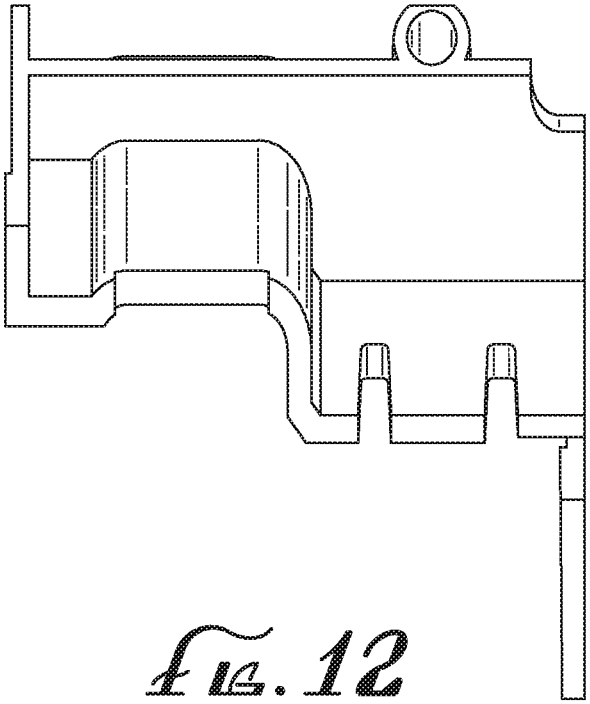
FIG. 12 is a left side view of the corner key of FIG. 4.
Figure 13:
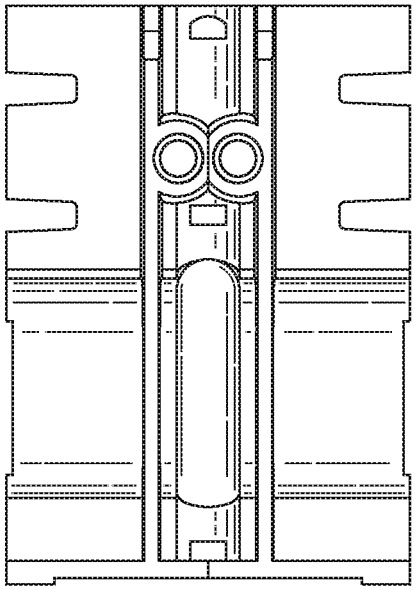
FIG. 13 is a top view of the corner key of FIG. 4.
Figure 14:
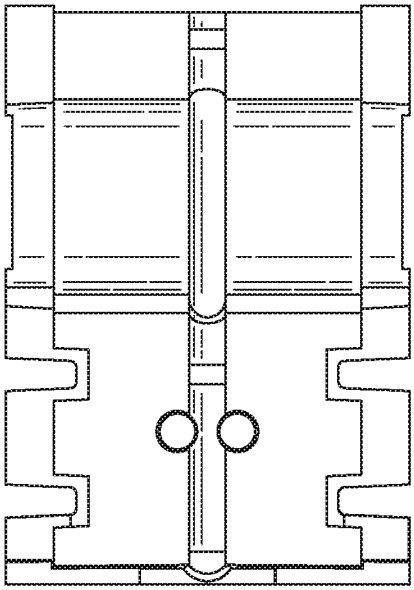
FIG. 14 is a bottom view of the corner key of FIG. 4.

In a first instance, an adhesive injection nozzle 301 may be aligned with nozzle-receiving end 222 of first injection port 220 so that nozzle 301 effectively seals against nozzle-receiving end 222 or aperture 124, and preferably against the funnel-shaped portion 256 of first injection port 220 proximate nozzle-receiving end 222, as illustrated in FIGS. 6 and 8. An alternate injection position through second injection port 250 is possible via injection nozzle 301' illustrated in phantom lines. In one embodiment, first and second apertures 124, 154 may be formed in the respective first and second frame members 110, 140 so that adhesive 300 may be injected into both first and second injection ports 220 and 250 simultaneously, using two nozzles or a double-outlet nozzle (not shown).

First injection port 220 and second injection port 250 are in fluid communication with each other via distribution pathway 260. As such, adhesive 300 injected via either first injection port 220 or second injection port 250, or both, is delivered to both first cavity 214 and second cavity 244. The inclusion of two injection ports 220, 250 allows a single corner key part to be utilized in all corners of fenestration frame 100 while allowing the injection location to be selected on either side of each corner. When adhesive 300 is injected through one of the first and second injection ports 220, 250, the adhesive 300 may also back-fill the other one of the injection ports 220, 250. The nozzle-receiving end 222 or 252 that is not aligned with aperture 124 may abut and be covered by the adjacent perimeter wall 120 or 150, effectively closing off that nozzle receiving end and its corresponding injection port, to inhibit back-flow and seepage therethrough. When cured, adhesive material 300 in the first and/or second injection port 220 or 250 forms a sprue that extends through the corner key 200.

Figure 7:
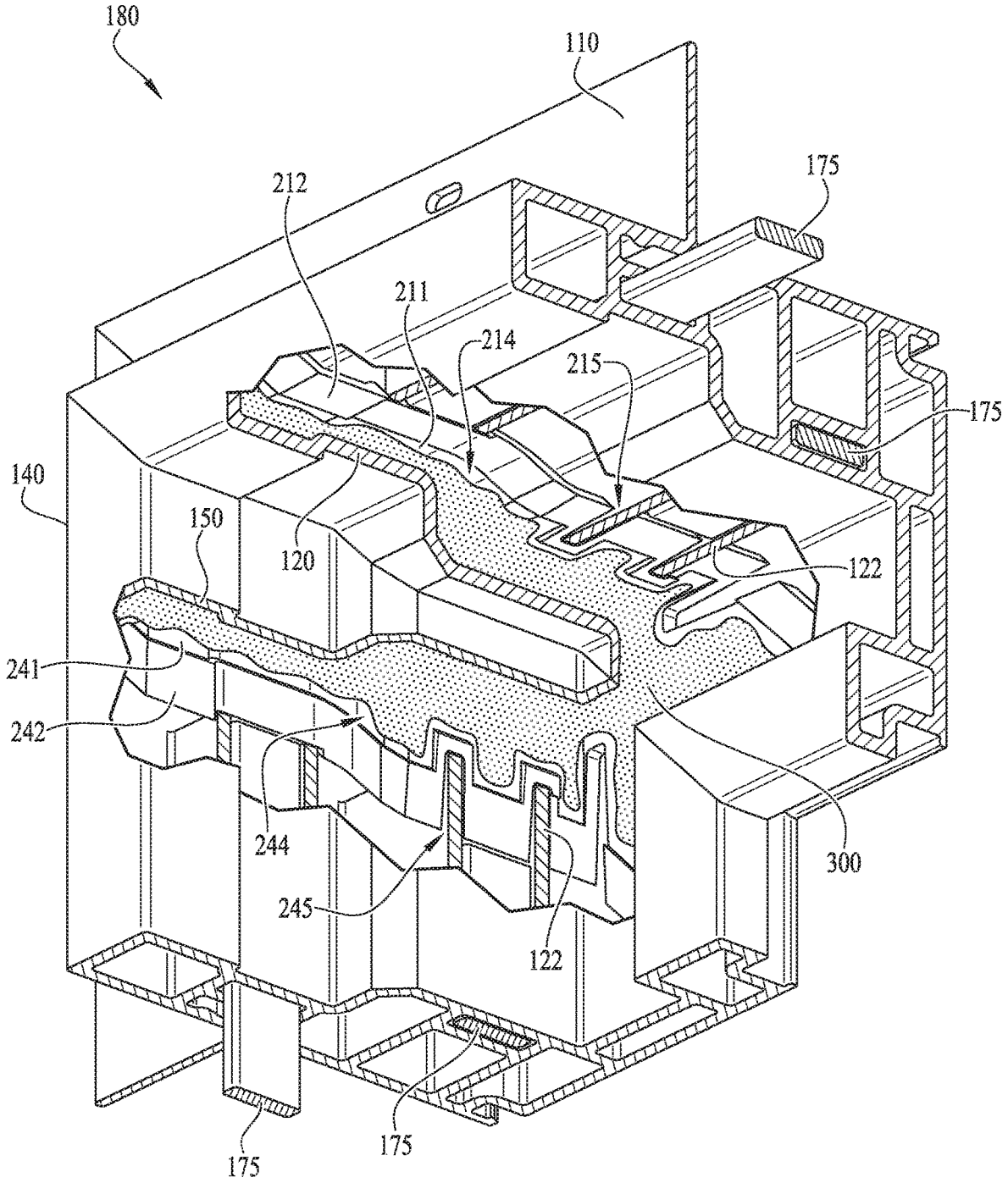
FIG. 7 is an isometric bottom-rear cutaway view of the corner joint of FIG. 2 with portions of the perimeter walls of the of the joined frame members cut away to show detail of the interface and adhesive bond between the corner key and the frame members.

FIG. 7 is a bottom isometric view of the back side of corner joint 180 with portions of the first perimeter wall 120 and the second perimeter wall 150 cut away to show adhesive 300 partially filling the first and second cavities 214, 244. First and second protrusions 212, 242 contact first and second perimeter walls 120,150 to form barriers that limit the flow of adhesive 300 distally, and help contain adhesive 300 within cavities 214, 244 during the adhesive curing process. In some embodiments, adhesive 300 may completely fill the first and second cavities 214, 244 such that the adhesive 300 is adjacent protrusions 212, 242. In still other embodiments, adhesive 300 may overfill one or both of first and second cavities 214, 244 and flow beyond protrusions 212, 242.

With reference to FIG. 7, one or more stiffening elements 175 may be inserted into one or more hollow regions 123 of first and second frame members 110, 140, and sized so as to avoid longitudinal interference with first and second legs 210, 240 of corner key 200 upon assembly of corner joint 180.

FIG. 8 is a cross-sectional view of corner joint 180 of FIG. 2 taken along line 8-8 of FIG. 2. FIG. 8 includes arrows illustrating the flow of adhesive 300 during injection. Injection nozzle 301 is shown disposed through aperture 124 of first perimeter wall 120 and engaging nozzle receiving end 222 of first injection port 220 to seal against funnel-shaped portion 156. Adhesive 300 injected via nozzle 301 flows through first injection port 220 and into distribution pathway 260, which may direct the flowing adhesive toward front side 270 and back side 271 of the corner key 200. Distribution pathway 260 may include a main channel (illustrated) running along an inside of the corner, in the plane of symmetry of corner key 200, and may further include runners (or secondary pathways) (not shown) extending transversely to the main channel, to distribute adhesive laterally from the main channel. Adhesive 300 flows from distribution pathway 260 distally into recesses 213, 243 (see also FIG. 6), filling first cavity 214 and second cavity 244. Distribution pathway 260 also directs the flow of adhesive along front blade portion 274 of corner key 200. Adhesive 300 may also flow through first transfer port 261 into third cavity 262 and through second transfer port 263 and/or third transfer port 264 into fourth cavity 265 on the opposite side of corner key 200 from distribution pathway 260. In some embodiments, adhesive 300 may flow into other gaps, crevices, pockets, and spaces between the first leg 210 and the first perimeter wall 120 and between the second leg 240 and the second perimeter wall 150 in addition to cavities 214, 244, 262, and 265. As previously described above, if aperture 154 is formed in second frame member 140, adhesive 300 may instead (or additionally) be injected through second injection port 250 to fill cavities 214, 244, 262, 265 in the same manner.

Manufacture of frame 100 may include but not be limited to the following steps or process. Each of the steps or process may be performed in any order unless specifically stated. A plurality of frame members may be cut to length in accordance with a desired frame geometry. The ends of the frame members may be specifically formed to establish a predetermined joint interface. For example, the ends of the frame members may be cut so as to provide a mitered interface. In some instances, each and every joint of the frame may be the same, i.e. the joining frame members may have the same cross-sectional geometry and the angle between the joined frame members may be the same. In other embodiments, one or more joints may be different one or more other joints. In the illustrated embodiment, the corner joints of the frame 100 are the same and thus the steps and processes below in relation to the corner joint 180 may apply to all corner joints of the frame 100.

Assessment may be performed based on the specific installation of the frame 100 to determine which of the first injection port 220 or the second injection port 250 may satisfy predefined criteria of the manufacture and/or installation of the frame 100. For example, predefined criteria may include, inter alia, visual aesthetics of the frame 100 and ease of access for injection of the adhesive 300. Upon choice of the first injection port 220 or the second injection port 250, a first aperture 124 or a second aperture 154 may be formed in the first perimeter wall 120 or the second perimeter wall 150, respectively.

An injection nozzle 301 may be inserted through the chosen first aperture 124 or second aperture 154 and engage the corresponding nozzle receiving end 222 or nozzle receiving end 252. Adhesive may be injected through the chosen first injection port 220 or second injection port 250 at least partially fill one or more of the cavities 214, 244, 262, and 265.

It will be obvious to those having skill in the art that many changes may be made to the details of the above-described embodiments without departing from the underlying principles of the invention. The scope of the present invention should, therefore, be determined only by the following claims.

The invention claimed is:

1. A structural joint between frame members of a fenestration system, comprising:

a first frame member including a first perimeter wall bordering a first hollow receiving region within the first frame member;

a second frame member including a second perimeter wall bordering a second hollow receiving region within the second frame member;

an insert joining the first and second frame members, the insert including:

a first leg disposed within the first hollow receiving region and forming a first adhesive-receiving cavity between the first leg and the first perimeter wall, a second leg disposed within the second hollow receiving region and forming a second adhesive-receiving cavity between the second leg and the second perimeter wall, a distribution pathway in fluid communication with the first cavity and the second cavity, a first injection port that extends through the first leg in fluid communication with the distribution pathway, and a second injection port that extends through the second leg in fluid communication with the distribution pathway, the second injection port spaced apart from the first injection port, and the second injection port extends parallel to the first injection port along a common wall region; and an adhesive material injected through the first injection port and at least partially filling the distribution pathway, the first cavity, and the second cavity, wherein the adhesive material in the first and second cavities bonds the insert to the first and second frame members, respectively, thereby forming a joint between the first and second frame members.

2. The structural joint of claim 1, wherein the first and second injection ports are tubular.

3. The structural joint of claim 1, wherein the common wall region divides the first injection port from the second injection port.

4. The structural joint of claim 1, wherein the first and second legs form a right angle therebetween.

5. The structural joint of claim 1, wherein the first and second injection ports are oriented at 45-degree angles relative to the respective first and second legs.

6. The structural joint of claim 1, wherein the first frame member includes an internal rib spanning between and coupling opposing portions of the first perimeter wall and dividing the hollow receiving region of the first frame member into multiple hollow regions.

7. The structural joint of claim 6, wherein:

the first leg of the insert includes at least one notch that divides the first leg into multiple tines and that nests with the internal rib; and each of the tines is received in a different one of the multiple hollow regions of the first frame member.

8. The structural joint of claim 7, wherein the first leg includes a protrusion that extends along a distal end of the first leg and protrudes toward and abuts the first perimeter wall to form a boundary of the first adhesive-receiving cavity, and wherein the protrusion contours along the entirety of the at least one notch to form a flow barrier along the at least one notch.

9. The structural joint of claim 1, wherein a nozzle-receiving end of each of the first and second injection ports is oval.

10. The structural joint of claim 1, wherein the first perimeter wall includes an aperture aligned with the first injection port, and the second perimeter wall covers the second injection port.

11. The structural joint of claim 1, wherein the first perimeter wall surrounds the first leg and the second perimeter wall surrounds the second leg.

12. An insert for joining frame members of a fenestration system, comprising:

a first leg configured for slidable insertion within a first hollow end portion of a first frame member, the first hollow end portion bordered by a first perimeter wall of the first frame member, the first leg of the insert includes at least one notch that divides the first leg into multiple tines and that is configured to nest with an internal rib of the first frame member and each of the tines is configured to be received in a different one of multiple hollow regions of the first frame member separated by the internal rib;

a second leg configured for slidable insertion within a second hollow end portion of a second frame member, the second hollow end portion is bordered by a second perimeter wall of a second frame member, wherein insertion of the first leg in the first hollow end portion is configured to establish a first adhesive-receiving cavity between the first leg and the first perimeter wall, and wherein insertion of the second leg in the second hollow end portion is configured to establish a second adhesive-receiving cavity between the second leg and the second perimeter wall;

a first injection port located on the insert configured to abut the first perimeter wall when the first leg is inserted into the first hollow end portion;

a second injection port located on the insert configured to abut the second perimeter wall when the second leg is inserted into the second hollow end portion; and a distribution pathway in fluid communication with the first and second injection ports and the first and second cavities, and the distribution pathway is configured to receive adhesive injected through either of the first and second injection ports and direct its flow into both the first and second cavities, when the first and second legs are inserted into the respective first and second hollow end portions.

13. The insert of claim 12, wherein the first injection port extends through the first leg and the second injection port extends through the second leg.

14. The insert of claim 12, wherein the first and second injection ports are tubular and extend parallel to each other.

15. The insert of claim 12, wherein the first and second injection ports share a common wall region that divides the first injection port from the second injection port.

16. The insert of claim 12, wherein the first and second legs form a right angle therebetween.

17. The insert of claim 12, wherein the first and second injection ports are oriented at 45-degree angles relative to the respective first and second legs.

18. The insert of claim 12, wherein the first leg includes a protrusion that extends along a distal end of the first leg and protrudes toward and abuts the first perimeter wall to form a boundary of the first adhesive-receiving cavity, and wherein the protrusion contours along the entirety of the at least one notch to form a flow barrier along the at least one notch.

19. The insert of claim 12, wherein a nozzle-receiving end of each of the first and second injection ports is oval.

20. A structural joint between frame members of a fenestration system, comprising:

a first frame member including a first perimeter wall bordering an interior of the first frame member, and the first frame member including an internal rib spanning between opposing portions of the first perimeter wall and dividing the interior of the first frame member into multiple hollow receiving regions;

a second frame member including a second perimeter wall bordering a second hollow receiving region within the second frame member;

an insert joining the first and second frame members, the insert including:

a first leg disposed within the first hollow receiving region and forming a first adhesive-receiving cavity between the first leg and the first perimeter wall, the first leg including at least one notch that divides the first leg into multiple tines and that receives the internal rib of the first frame member, and each of the tines is received in a different one of the multiple hollow receiving regions, and a second leg disposed within the second hollow receiving region and forming a second adhesive-receiving cavity between the second leg and the second perimeter wall; and an adhesive material at least partially filling the first cavity and the second cavity, wherein the adhesive material in the first and second cavities bonds the insert to the first and second frame members, respectively, thereby forming a joint between the first and second frame members.

21. The structural joint of claim 20, wherein the first leg includes a protrusion that extends along a distal end of the first leg and protrudes toward and abuts the first perimeter wall to form a boundary of the first adhesive-receiving cavity, and wherein the protrusion contours along the entirety of the at least one notch to form a flow barrier along the at least one notch.

22. A method of making a fenestration frame from multiple elongate frame members having hollow receiving regions bordered by perimeter walls, comprising:

obtaining an insert including a first leg having a first recess formed therein, a second leg having a second recess formed therein, a first injection port that extends through the first leg in fluid communication with the first and second recesses, a second injection port spaced apart from the first injection port and in fluid communication with the first and second recesses the second injection port extends through the second leg and the second injection port extends parallel to the first injection port along a common wall region;

forming an aperture through a first perimeter wall of a first frame member and into a first hollow receiving region of the first frame member;

inserting the first leg into the first hollow receiving region of the first frame member so that the first injection port is positioned in alignment with the aperture, and inserting the second leg into a second hollow receiving region of a second frame member so that the second injection port is covered by a second perimeter wall of the second frame member bordering the second hollow receiving region, and whereupon the first recess and the first perimeter wall form a first adhesive-receiving cavity bordered by the first perimeter wall, and the second recess and the second perimeter wall form a second adhesive-receiving cavity bordered by the second perimeter wall;

aligning a nozzle with the first injection port;

injecting a flowable adhesive material through the nozzle and the first injection port until the adhesive material at least partially fills the first and second cavities; and curing the adhesive material in the first and second cavities to bond the insert to the first and second frame members, respectively, thereby forming a joint between the first and second frame members.

23. The method of claim 22, wherein at least the first frame member includes an internal rib spanning between opposing portions of the first perimeter wall of the first frame member and dividing the hollow receiving region of the first frame member into multiple hollow regions, and further comprising:

removing an end portion of the internal rib before inserting the first leg into the hollow receiving region of the first frame member.

24. The method of claim 23, wherein the first leg of the insert includes at least one notch that divides the first leg into multiple tines, and wherein:

the step of removing of the end portion of the internal rib includes removing the end portion of the internal rib to a predetermined depth such that, when the first leg is inserted into the first frame member, the internal rib extends into the notch and each one of the multiple tines is received in a different one of the multiple hollow regions of the first frame member.

* * * * *